US006336807B1

(12) United States Patent
Hsu

(10) Patent No.: US 6,336,807 B1
(45) Date of Patent: Jan. 8, 2002

(54) GAS LIGHTER WITH DUAL SAFETY MECHANISM

(76) Inventor: Huang-Hsi Hsu, 8F, No. 14, Lane 252, Chungshan N. Rd., Sec. 6, Taipei (TW)

( * ) Notice: Subject to any disclaimer, the term of this patent is extended or adjusted under 35 U.S.C. 154(b) by 0 days.

(21) Appl. No.: 09/672,995

(22) Filed: Sep. 29, 2000

(51) Int. Cl.[7] ..... F23Q 2/28
(52) U.S. Cl. ..... 431/153; 431/255
(58) Field of Search ..... 431/153, 255

(56) References Cited

U.S. PATENT DOCUMENTS 6,059,563 A * 5/2000 Hsu ..... 431/153

* cited by examiner

*Primary Examiner*—Sara Clarke
(74) *Attorney, Agent, or Firm*—Bacon & Thomas, PLLC

(57) ABSTRACT

A gas lighter in which a stop mechanism is disposed between the ignition button and fuel tank of the gas lighter and adapted to stop the ignition button from triggering the electric arc generator of the gas lighter and moving the gas lever of the fuel tank in opening the fuel gas outlet, the stop mechanism including a base frame, two spring-supported links slidably mounted on the base frame and adapted for pressing by the ignition button to press the electric arc generator and the gas lever, and a lever extended from the base frame to the outside of the gas lighter for turning by hand to move the links in and out of the working position.

9 Claims, 6 Drawing Sheets

GAS LIGHTER WITH DUAL SAFETY MECHANISM

BACKGROUND OF THE INVENTION

The present invention relates to gas lighters, and more particularly to a gas lighter with dual safety mechanism, which comprises a stop mechanism controlled by a lever to stop the ignition button of the gas lighter from triggering the electric arc generator of the gas lighter and moving the gas lever of the fuel tank in opening the fuel gas outlet.

U.S. Pat. No. 6,059,563 discloses a gas lighter with dual safety mechanism, which was filed on Oct. 12, 1999 and issued to the present inventor on Mar. 9, 2000. This structure of gas lighter 1, as shown in FIG. 1, comprises a substantially rectangular handgrip 10 with a tube 12 at its one end, a fuel tank 14 and an electric arc generator 16 mounted inside the handgrip 10. The fuel tank 14 has a gas outlet 142 connected to a gas nozzle in the tube 12 (not shown) by a gas hose 144, and a gas lever 146 adapted to close/open the gas outlet 142. The handgrip 10 has an opening 18. An ignition button 19 is suspended in the handgrip 10 and partially projecting out of the opening 18. The bottom side of the ignition button 19 faces the actuator 162 of the electric arc generator 16. The electric arc generator 162 has a first electrode 164 connected to the gas nozzle, and a second electrode 166 connected to the tube 12. As illustrated in FIGS. 1 and 2, the stop mechanism 2 is provided between the ignition button 19 and the fuel tank 14 inside the handgrip 10. The stop mechanism 2 comprises a base frame 20 pivoted to the handgrip 10, a lever 22 inserted through a hole on the handgrip 10 and connected to the base frame 20, a first spring element 202 adapted to return the base frame 20 after the lever 22 being pressed and then released, a link 24 slidably coupled to the base frame 20 and aimed at the ignition button 19, and a second spring element 242 adapted to return the link 24 after the link 24 being pressed and then released. When turning the lever 22 of the stop mechanism 2 to move the link 24 to the fuel tank 14 and then pressing the ignition button 19, the link 24 is forced downwards against the gas lever 146, causing the fuel tank 14 to release fuel gas through the gas hose 144 to the gas nozzle, and at the same time the actuator 162 of the electric arc generator 16 is triggered to generate an electric arc around the gas nozzle, and therefore a flame is produced at the gas nozzle. If the lever 22 of the stop mechanism 2 is not turned to the unlocking position before pressing the ignition button 19, the down stroke of the ignition button 19 can only trigger the electric arc generator 16 to generate an electric arc without opening the gas outlet 142 of the fuel tank 14. However, this design is still not satisfactory in function. Because the actuator 162 of the an electric arc generator 16 will be triggered when pressing the ignition button 19 without turning the lever 22 of the stop mechanism 2 to the unlocking position, the gas lighter 1 is still not safe in use. When a child plays with the gas lighter and presses the ignition button 19 by an accident, an electric arc will be produced, and the child may be injured by the electric arc.

SUMMARY OF THE INVENTION

The invention has been accomplished under the circumstances in view. According to one aspect of the present invention, the gas lighter comprises a stop mechanism disposed between the ignition button and fuel tank of the gas lighter and adapted to stop the ignition button from triggering the electric arc generator of the gas lighter and moving the gas lever of the fuel tank in opening the fuel gas outlet.

The stop mechanism comprises a base frame, two spring-supported links slidably mounted on the base frame and adapted for pressing by the ignition button to press the electric arc generator and the gas lever, and a lever extended from the base frame to the outside of the gas lighter for turning by hand to move the links in and out of the working position. According to another aspect of the present invention, if the gas lever is not turned to move the links to the working position, the ignition button does not drive the actuator of the electric arc generator and the gas lever of the fuel tank when pressed, and therefore neither electric arc is produced nor fuel gas is discharged out of the fuel tank at this time. Because no electric arc is produced when pressing the ignition button before turning the lever of the stop mechanism to move the links to the working position, the gas lighter will not be triggered to generate an electric arc by an accident.

DETAILED DESCRIPTION OF THE PREFERRED EMBODIMENT

Figure 1:
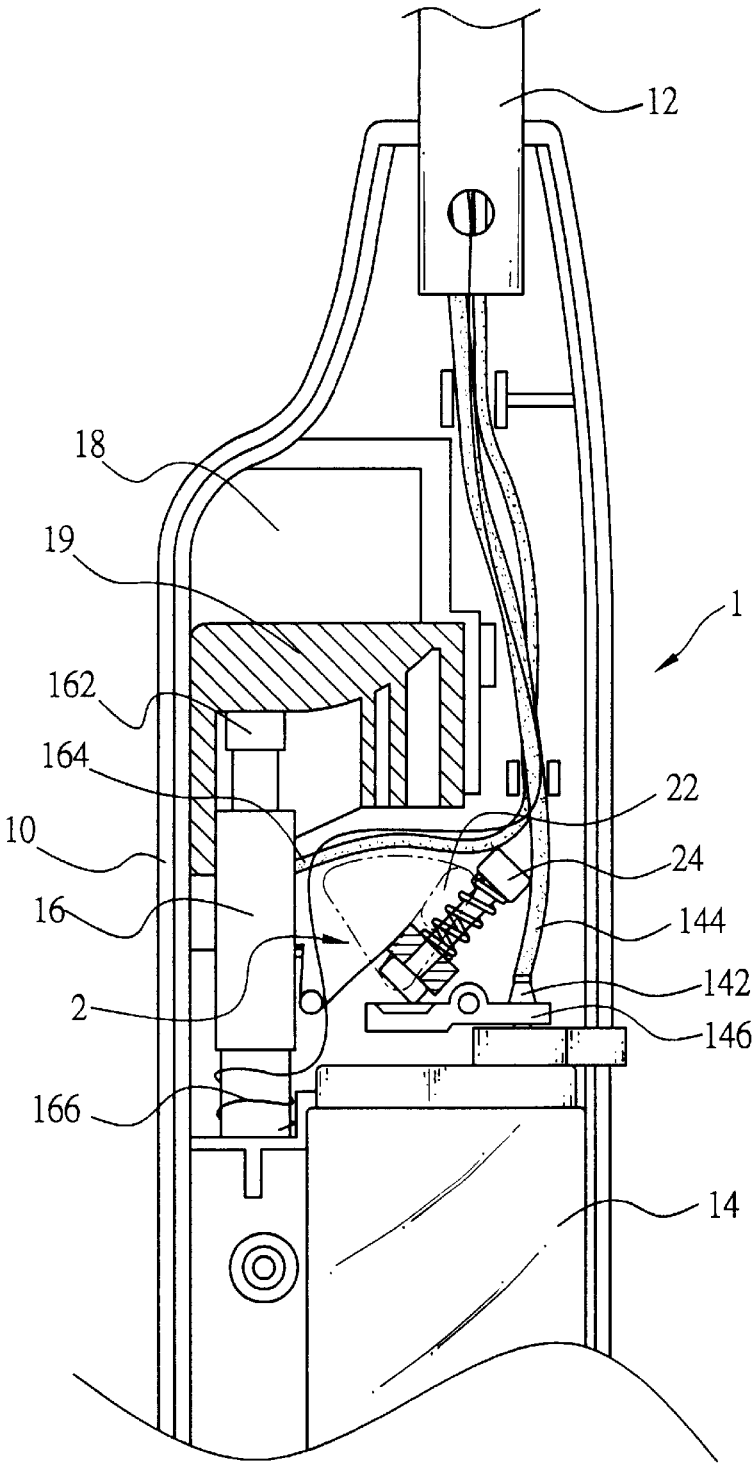
PRIOR ART FIG.1
FIG. 1 is a plain view of a gas lighter according to the prior art.
Figure 2:
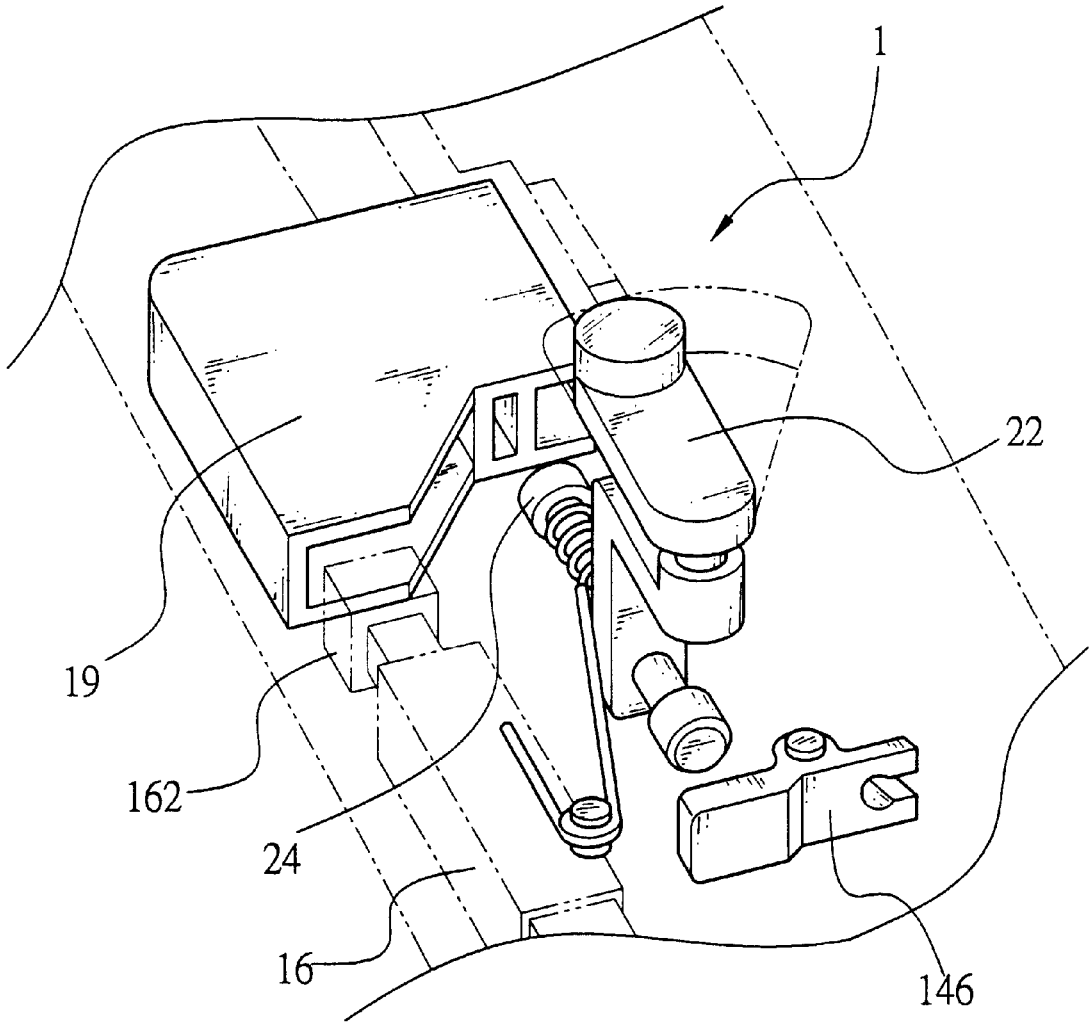
PRIOR ART FIG.2
FIG. 2 is a perspective view in an enlarged scale of a part of FIG. 2.

Referring to FIGS. From 3 through 6, a gas lighter 3 comprises a stop mechanism 6 disposed between the ignition button 4 and fuel tank 5 thereof. When turning the lever 62 of the stop mechanism 6 to move first and second links 64 and 64' of the stop mechanism 6 toward the electric arc generator 7 of the gas lighter 3 and the gas lever 52 of the fuel tank 5 and then pressing the ignition button 4, the second link 64' is pressed on the gas lever 52 causing fuel gas to flow out of the fuel tank 5 to the metal gas nozzle 34 of the gas lighter 3, and at the same time the second link 64' is pressed on the actuator 72 of the electric arc generator 7, causing the electric arc generator 7 to discharge an electric arc around the gas nozzle 34, and therefore fuel gas is burned at the fuel gas outlet of the gas nozzle 34. If the lever 62 of the stop mechanism 6 is not turned to the aforesaid position, pressing the ignition button 4 does not actuate the gas lighter 3.

Figure 3:
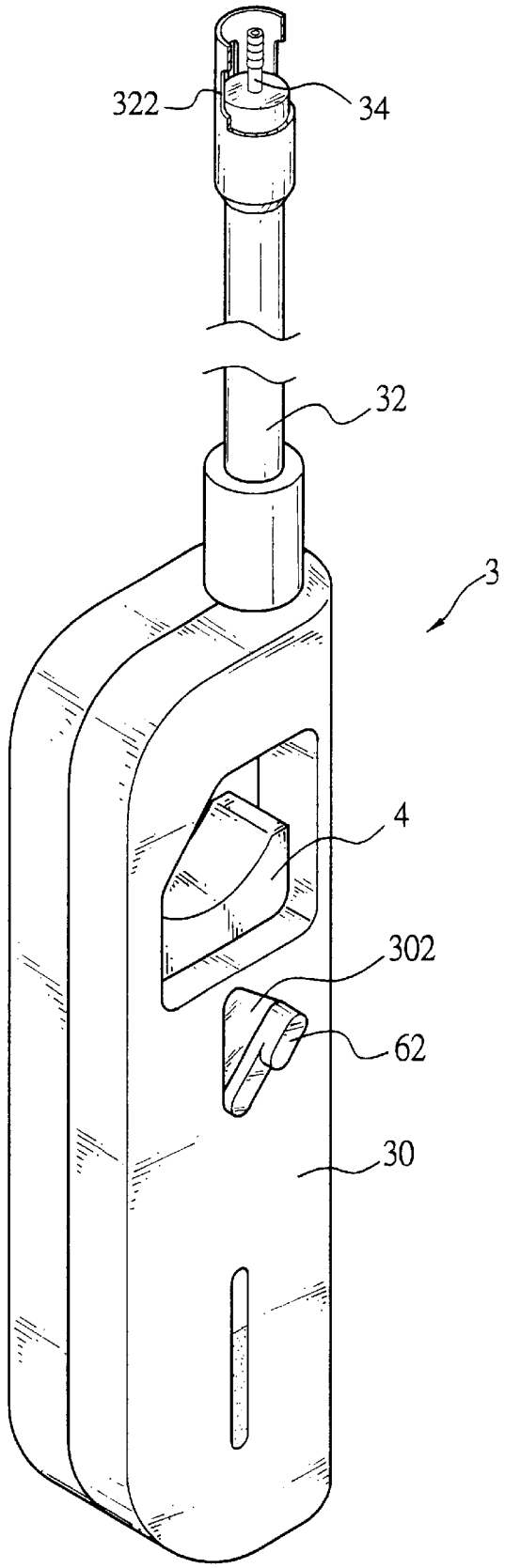
FIG. 3 is an elevational view of a gas lighter according to the present invention.

Referring to FIG. 3 again, the gas lighter 3 comprises a substantially rectangular handgrip 30, and a cylindrical metal casing 32 longitudinally extended from one end (the short side) of the rectangular handgrip 30. The cylindrical metal casing 32 has a plurality of air vents 322 spaced around the periphery of the free end (the end remote from the handgrip 30) corresponding to the gas nozzle 34.

Figure 5:
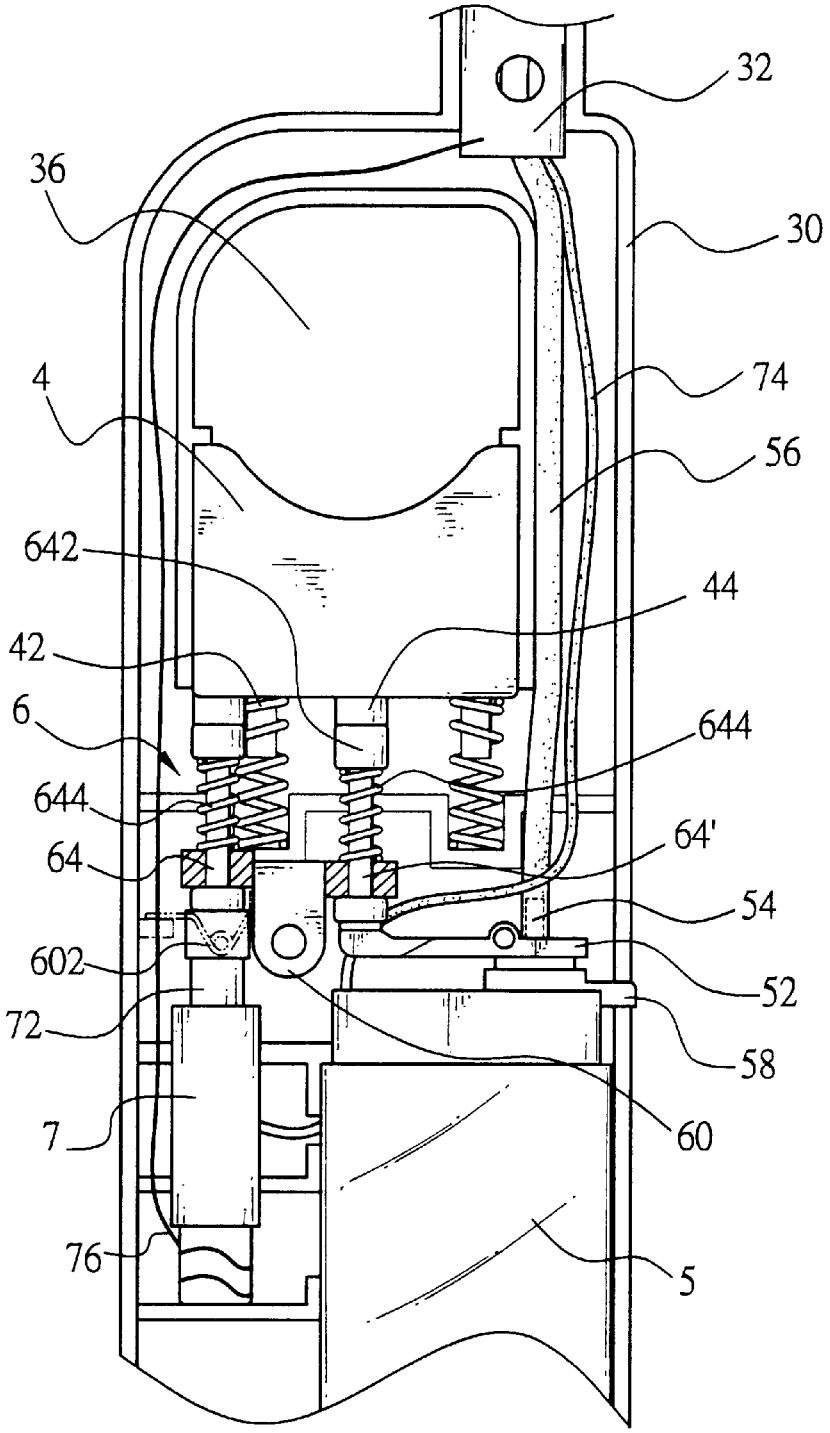
FIG. 5 is a schematic drawing showing the operation of the present invention (I).
Figure 6:
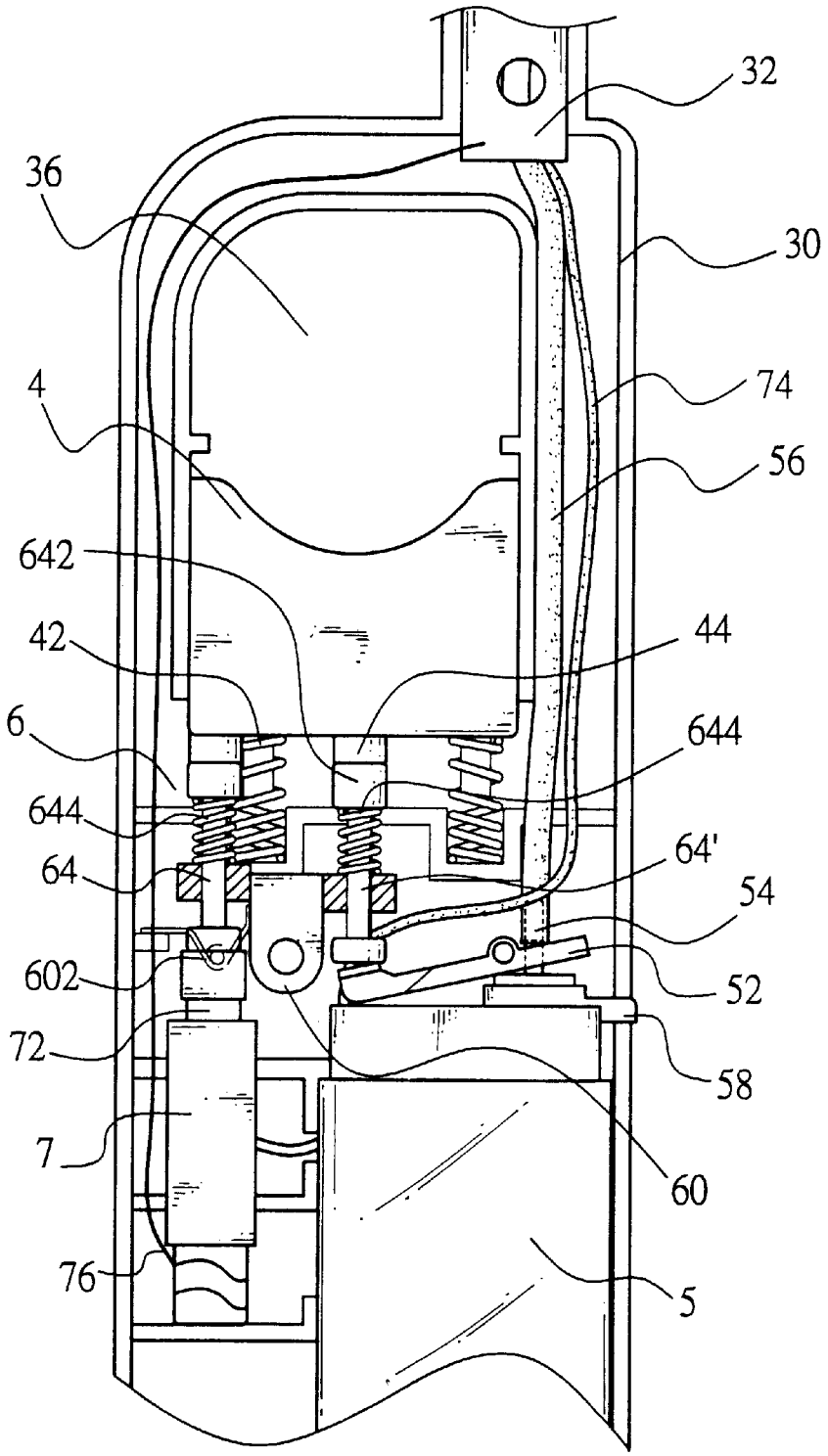
FIG. 6 is a schematic drawing showing the operation of the present invention (II).

Referring to FIGS. 5 and 6 again, the fuel tank 5 is mounted within the handgrip 30 at one side remote from the tube 32. The gas lever 52 is pivoted to the fuel gas outlet stopper 54 of the fuel tank 5. The fuel gas outlet 54 is connected to the gas nozzle 34 by a hose 56. When the gas lever 52 is pressed, the fuel gas outlet stopper 54 is pulled to open the fuel gas outlet of the fuel tank 5, enabling fuel gas to flow through the hose 56 to the gas nozzle 34. A regulator 58 is disposed adjacent to the gas lever 52 and partially projecting out of the handgrip 30 for rotation by hand to regulate the flow rate of fuel gas passing through the hose 56. The electric arc generator 7 is mounted inside the handgrip 30 adjacent to the fuel tank 5. The actuator 72 of the electric arc generator 7 is disposed adjacent to the gas lever 52. One electrode 74 of the electric arc generator 7 is connected to the gas nozzle 34. The other electrode 76 of the electric arc generator 7 is connected to the cylindrical metal casing 32. When triggering the actuator 72, an electric arc is produced between the gas nozzle 34 and the cylindrical casing 32.

Figure 4:
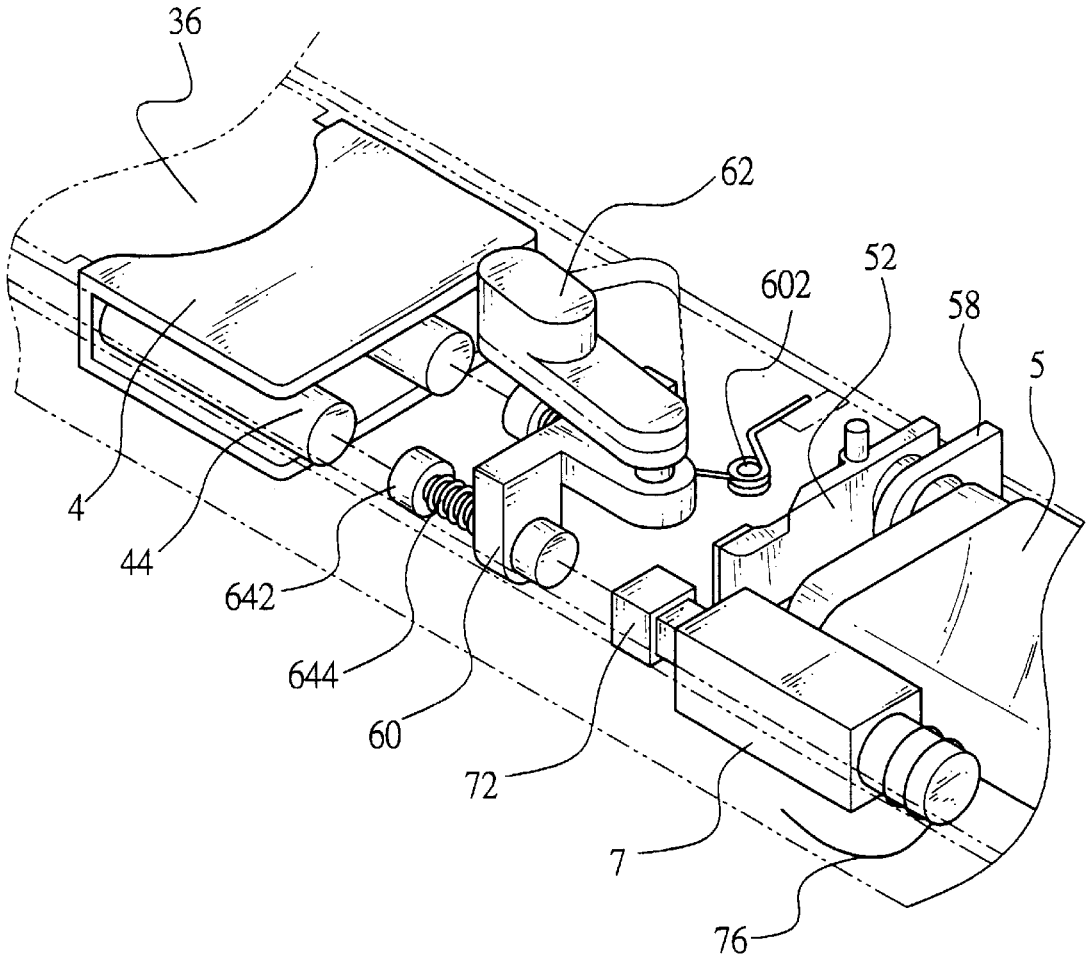
FIG. 4 is a perspective view of a part of the present invention, showing the arrangement of the stop mechanism, the ignition button, the fuel tank and the electric arc generator inside the handgrip.

Referring to FIGS. 3 and 4 again, the handgrip 30 has a through hole 36 near the cylindrical casing 32. The ignition button 4 has one end extended into the through hole 36, and the other end supported on spring means, for example, a compression spring 42. The compression spring 42 pushes the ignition button 4 back to its former position after being pressed. The ignition button 4 comprises two press rods 44 respectively aimed at the actuator 72 and the gas lever 52.

Referring to FIG. 4 again, the stop mechanism 6 comprises a base frame 60 pivoted to the inside of the handgrip 30, and spring means, for example, a torsional spring 602 connected between the handgrip 30 and the base frame 60. The handgrip 30 has an opening 302. The lever 62 of the stop mechanism 6 is inserted through the opening 302 and connected to the base frame 60, and can be turned within the opening 302. The torsional spring 602 pushes the base frame 60 and the lever 62 to their former positions after being pressed by the ignition button 4. The links 64 and 64' are disposed adjacent to the ignition button 4, each having two end blocks 642 at two distal ends. Two spring elements, for example, compression springs 644 are respectively mounted on the links 64 and 64' . Each compression spring 644 has one end stopped at one end block 642 of the link 64 or 64', and the other end stopped at the base frame 60. The compression springs 644 push the links 64 and 64' back to their former positions after the links 64 and 64' having been pressed and then released.

Referring to FIGS. 5 and 6 again, when turning the lever 62 to move the links 64 and 64' to the actuator 72 and the gas lever 52, the ignition button 4 is pressed to force the press rods 44 against the links 64 and 64', causing the links 64 and 64' to press the actuator 72 and the gas lever 52 respectively, and therefore the fuel gas outlet stopper 54 is pulled to open the fuel gas outlet of the fuel tank 5, enabling fuel gas to flow through the hose 56 to the gas nozzle 34, and at the same time the electric arc generator 7 is triggered to discharge an electric arc around the gas nozzle 34 in burning discharged fuel gas at the gas nozzle 34.

Referring to FIG. 4 again, if the lever 62 of the stop mechanism 6 is not turned to move the links 64 and 64' to the actuator 72 and the gas lever 52, pressing the ignition button 4 does not cause the press rods 44 to press the links 64 and 64' against the actuator 72 and the gas lever 52, and therefore the electric arc generator 7 neither produces sound nor generates an electric arc and the fuel tank 5 does not provide fuel gas to the gas nozzle 34, i.e., the gas lighter 3 does no work at this time.

If a child plays with the gas lighter 3 and presses the ignition button 4, the gas lighter 3 does not produce an electric arc around the gas nozzle 34. Therefore, the gas lighter 3 is safe in use.

While only one embodiment of the present invention has been shown and described, it will be understood that various modifications and changes could be made thereunto without departing from the spirit and scope of the invention disclosed.

What the invention claimed is:

1. A gas lighter comprising:

a handgrip, said handgrip comprising a cylindrical metal casing extending from one end thereof;

a metal gas nozzle suspended in a free end of said cylindrical metal casing remote from said handgrip;

a fuel tank mounted in said handgrip remote from said cylindrical metal casing and holding a fuel gas, said fuel tank comprising a fuel gas outlet, a gas hose connected between said fuel gas outlet and said metal gas nozzle, a fuel gas stopper adapted to close/open said fuel gas outlet, and a gas lever coupled to said fuel gas stopper and adapted to move said fuel gas stopper to close/open said fuel gas outlet;

an electric arc generator mounted inside said handgrip adjacent to said fuel tank, said electric arc generator comprising a first electrode connected to said gas nozzle, a second electrode connected to said cylindrical metal casing, and an actuator adapted to be pressed to produce an electric arc between said cylindrical metal casing and said metal gas nozzle;

an ignition button mounted in said handgrip and partially extended out of said handgrip and adapted for pressing said actuator of said electric arc generator and said gas lever, said ignition button comprising two press rods respectively aimed at said actuator of said electric arc generator and said gas lever of said fuel tank;

first spring means mounted inside said handgrip and adapted to return said ignition button after said ignition button has been pressed;

a stop mechanism mounted inside said handgrip between said ignition button and said fuel tank and adapted to stop said ignition button from pressing said actuator of said electric arc generator and said gas lever of said fuel tank, said stop mechanism comprising two links, and a lever adapted to move said links between a first position where said links are moved to the press rods of said ignition button for pressing said actuator of said electric arc generator and said gas lever of said fuel tank upon pressing of said ignition button, and a second position where said links are moved away from the press rods of said ignition button, preventing said ignition button from pressing said actuator of said electric arc generator and said gas lever of said fuel tank; and second spring means mounted in said handgrip and supporting said stop mechanism in said second position.

2. The gas lighter of claim 1 wherein said cylindrical metal casing comprises a plurality of air vents spaced around the periphery of the free end thereof corresponding to said gas nozzle.

3. The gas lighter of claim 1 wherein said handgrip comprises a through hole, which receives a part of said ignition button for enabling said ignition button to be pressed with the user's finger.

4. The gas lighter of claim 1 wherein said first spring means is a coil spring.

5. The gas lighter of claim 1 wherein said links each have two expanded end blocks at two distal ends.

6. The gas lighter of claim 5 further comprising third spring means respectively mounted on said links and adapted to return said links after said links being pressed.

7. The gas lighter of claim 6 wherein said third spring means comprises two compression springs respectively mounted on said links.

8. The gas lighter of claim 1 wherein said stop mechanism further comprises a base frame pivoted to said handgrip and supported on said second spring means and adapted to hold said links for enabling said links to be moved relative to said base frame, and two springs adapted to return said links, said links each having two end blocks at two distal ends, the springs of said stop mechanism being respectively mounted on said links each having one end stopped at one end block of the corresponding link and an opposite end stopped at said base frame; said handgrip has an opening corresponding to said stop mechanism for the passing of one end of the lever of said stop mechanism to the outside of said handgrip.

9. The gas lighter of claim 1 wherein said fuel tank comprises a regulator partially projecting out of said handgrip and adapted for regulating the flow rate of the fuel gas passing out of said fuel tank to said gas hose.

* * * * *